US006009560A

United States Patent [19]

McKenney et al.

[11] Patent Number: 6,009,560

[45] Date of Patent: Jan. 4, 2000

[54] PERFORATED REFLECTIVE TRIM FOR USE WITH GARMENTS

[75] Inventors: Bill McKenney, Stanton, Ky.; Frank Taylor, Dayton, Ohio; Charlie Banks, Fillmore, Ky.

[73] Assignee: Lion Apparel, Inc., Dayton, Ohio

[21] Appl. No.: 09/195,878

[22] Filed: Nov. 19, 1998

Related U.S. Application Data

[60] Provisional application No. 60/066,257, Nov. 20, 1997.

[51] Int. Cl.[7] ..... A41D 27/00

[52] U.S. Cl. ..... 2/244; 2/81; 2/93; 2/448

[58] Field of Search ..... 2/81, 244, 458, 2/93

[56] References Cited

U.S. PATENT DOCUMENTS

| | | | |
|---|---|---|---|
| Re. 30,892 | 3/1982 | Bingham et al. | 428/241 |
| 1,739,289 | 12/1929 | Carter . | |
| 3,790,431 | 2/1974 | Tung | 161/3.5 |
| 3,811,983 | 5/1974 | Rowland | 156/245 |
| 4,103,060 | 7/1978 | Bingham et al. | 428/241 |
| 4,517,685 | 5/1985 | Lesley | 2/170 |
| 4,755,407 | 7/1988 | Mortensen et al. | 428/36 |
| 5,095,549 | 3/1992 | Aldridge | 2/304 |
| 5,207,852 | 5/1993 | Lightle et al. | 156/230 |
| 5,406,648 | 4/1995 | Butzer et al. | 2/81 |
| 5,697,101 | 12/1997 | Aldridge | 2/81 |
| 5,701,606 | 12/1997 | Aldridge | 2/81 |
| 5,860,163 | 1/1999 | Aldridge | 2/81 |

OTHER PUBLICATIONS

Gore Literature, "Crosstech Moisture Barrier" 1998.

*Primary Examiner*—John J. Calvert
*Assistant Examiner*—Robert H. Muromoto, Jr.
*Attorney, Agent, or Firm*—Thompson Hine & Flory LLP

[57] ABSTRACT

A firefighting garment having an outer shell of abrasion, flame and heat resistant material and a reflective trim attached to the outer shell wherein the reflective trim includes a multiplicity of open perforations which facilitate water and water vapor transport through the trim.

6 Claims, 2 Drawing Sheets

PERFORATED REFLECTIVE TRIM FOR USE WITH GARMENTS

CROSS REFERENCE TO RELATED APPLICATIONS

This application claims priority under 35 U.S.C. §119 from Provisional Application Ser. No. 60/066,257, filed Nov. 20, 1997.

BACKGROUND

The present invention relates to firefighter and other hazardous duty garments, and more particularly, reflective trim for use with such garments.

Reflective trim material is used on the outer shells of hazardous duty garments such as firefighter garments, as well as on jogging suits and construction worker garments, to make the wearers of such garments more visible to others in low visibility areas or in vehicle headlights in dark or low-light environments. Thus, reflective trim material provides an advantageous safety factor for the wearers of such garments.

Firefighter garments present special problems to a wearer. Unlike other types of garments, firefighter garments are to be worn in extremely hazardous environments, and must be designed to withstand temperatures in excess of 500° F. without significant degradation. A firefighter garment typically is comprised of an outer shell of an aramid fiber such as NOMEX (a trademark of E.I. Dupont de Nemours & Co.), a moisture barrier comprised of a semi-permeable membrane bonded or otherwise attached to a substrate of an aramid fiber, and a thermal liner, which typically consists of a batting of aramid fibers. While such an ensemble will withstand the necessary heat and moisture (which tends to reduce the heat resistant capacity of a firefighter garment if the thermal barrier becomes soaked with moisture) a significant problem has arisen with respect to the stress imposed on a wearer resulting from trapping heat within such firefighter garments.

Since the human body eliminates heat primarily through the mechanism of the evaporation of liquid perspiration, any clothing which restricts or inhibits the transport of perspiration moisture vapor will cause a build-up of perspiration—and hence heat—within the coat, resulting in added stress to the wearer. Consequently, it is important to maximize the flow of perspiration moisture vapor outwardly from the wearer through the aforementioned components of the firefighter ensemble.

Conventional reflective trim material is applied to the outer shell of a firefighter garment and is a continuous non-permeable, non-perforated sheet of material. A problem with such reflective trim material is that it does not easily permit the transfer of perspiration moisture vapor. Accordingly, use of such reflective trim material on the outershell restricts the rate that moisture vapor permeates through the outershell of the garment. Consequently, areas of the firefighter garment under the reflective trim material retain an undesirable amount of water, if such moisture vapor condenses. Such excess water retained by the firefighter garment may impose added weight, block further moisture vapor transfer, and/or transfer external heat to the wearer.

Accordingly, there is a need to facilitate moisture vapor transport through the outer layers of the garment, especially through portions of the outer layer covered by reflective trim material.

Attempts have been made to enhance water vapor transport from a wearer of a garment through the garment and reflective trim to the external environment. One such attempt is illustrated in the 1997 edition of N.F.P.A. 1971, which is incorporated by reference herein. In particular, paragraph 4-1.14.5 of the N.F.P.A. 1971 calls for staggering the reflective trim on the sleeves of firefighter garments (see N.F.P.A. 1971 (1997) FIG. 4-1.14.5 options 2 and 4). However, the staggered trim configuration makes it difficult for wearers of the garment to flex their elbows.

Another attempt at making breathable reflective trim material is disclosed in U.S. Pat. No. 5,207,852 to Lightle et al. That patent discloses a flexible, air-permneable retroreflective sheeting for clothing having retroreflective elements partially embedded on one side of the fabric. Microspheres having reflective layers provide the reflectivity characteristic of the material. The reflective sheeting employs an air-permeable web which facilitates the transport of air into and out of the garment. Accordingly, the permeability of this reflective sheeting is an inherent characteristic of the air-permeable web employed in the sheeting. No perforations are incorporated into the reflective sheeting. The manufacture of such retroreflective sheeting is reasonably costly due to the various components needed to be combined to make such sheeting.

Accordingly, there is a need for a breathable reflective trim material for use with garments, especially firefighter garments, which can enhance the transport of vapor such as water or moisture vapor from a wearer of the garment to the external environment; and there is a need for a breathable reflective trim suitable for use with firefighter garments which can be cost effectively and efficiently manufactured.

SUMMARY

The present invention is a perforated reflective trim for use with garments, especially hazardous duty garments such as firefighter garments, and a process for making such trim. The perforated reflective trim of the invention comprises a reflective portion adhesively bonded to a substrate portion and a plurality of open perforations extending through both the reflective and substrate portions to facilitate moisture transport through the trim. In another embodiment of the invention, the perforated reflective trim is attached to the outer shell of a firefighting garment.

The invention also encompasses a method for producing a perforated reflective material by perforating a substantially nonporous reflective material. In another method according to the present invention, the perforated reflective trim is attached to a garment by stitching. The thread used to stitch the trim to the garment is positioned through lines of perforations adjacent to the longitudinal edges of the trim.

It has been found that by perforating conventional reflective trim, which is ultimately attached to garments, such as firefighter garments, the transport of water or moisture vapor from a wearer of the garment through the garment and reflective trim to the external environment is enhanced. Accordingly, the present invention is a perforated reflective trim that provides enhanced breathability to garments.

Breathability of garments is an important factor in managing the microclimate within the garment. Moisture vapor transport from layers of a garment to the external environment is especially important with respect to firefighter garments. It is desired to maximize moisture vapor transport of the wearer's perspiration through the various breathable layers of the garment. Firefighters often are in extremely high temperature environments and extremely wet environments. Although firefighter garments incorporate means to prevent excessive absorption of water by utilizing moisture barriers and/or breathable layers, there is always a potential that water can be absorbed, at least temporarily, by the firefighter garments. As a result, firefighter garments are constructed to enhance the transport of water vapor from the firefighter garments to the external environment. Conventional reflective trim, however, is substantially impermeable to water vapor and thus traps the water vapor under the reflective trim within the garment. The trim is relatively dense and, therefore, it tends to absorb and hold heat. The reflective trim of the present invention alleviates this problem and allows the transport of water vapor from the garment to the external environment through the perforated reflective trim.

Accordingly, it is an object of the present invention to provide a firefighter or other hazardous duty garment with perforated reflective trim on its outer shell to allow the release of heat and moisture vapor from beneath the trim; a garment in which the perforated reflective trim provides improved breathability to the garment; a garment in which the fabric underneath the reflective trim dries faster to provide better thermal insulation than wet fabric; a garment with improved microclimate within the garment which reduces the amount of stress on the firefighter; and a garment which is relatively easy to fabricate.

Other objects and advantages of the present invention will be apparent from the following description, the accompanying drawings and the appended claims.

DETAILED DESCRIPTION

Figure 1:
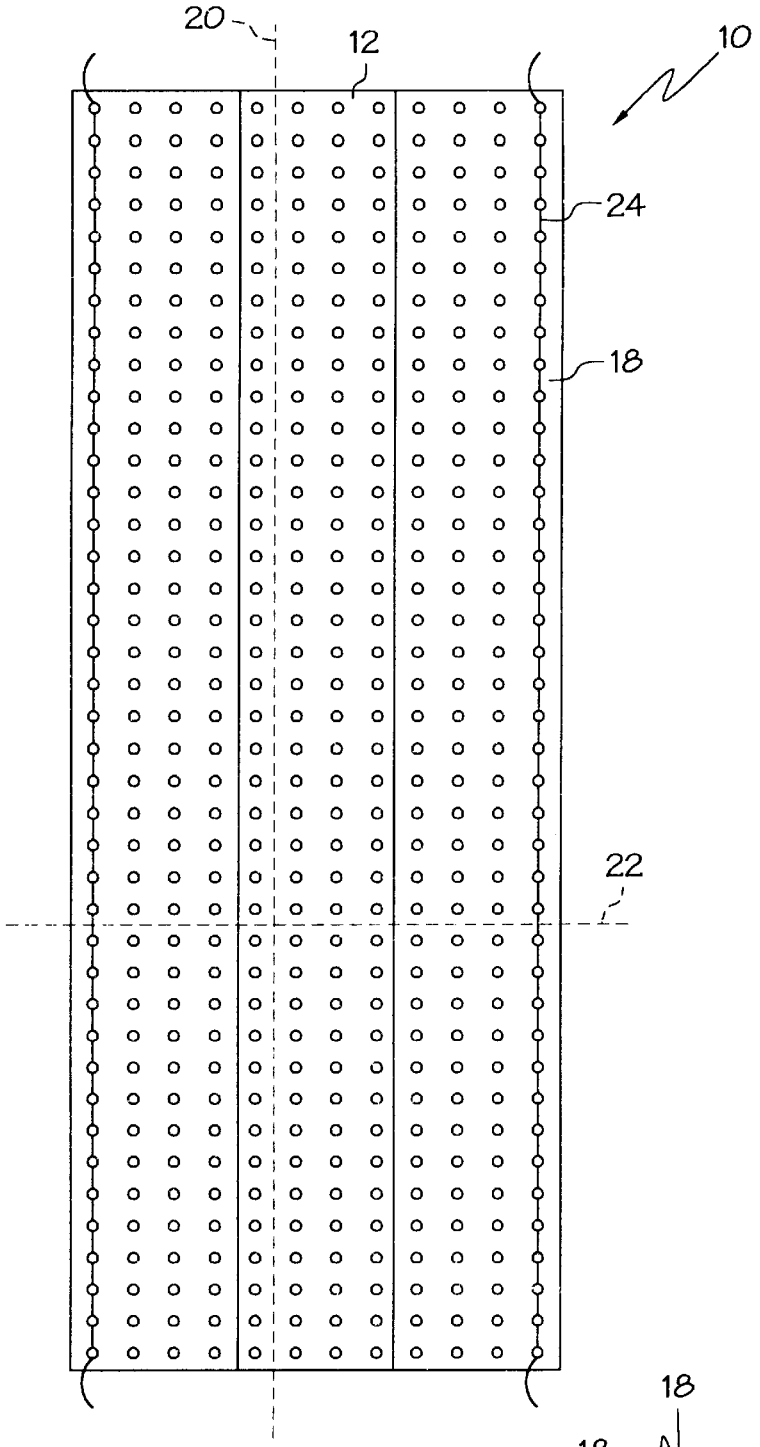
FIG. 1 is a plan view of a perforated reflective trim embodying the present invention.
Figure 2:
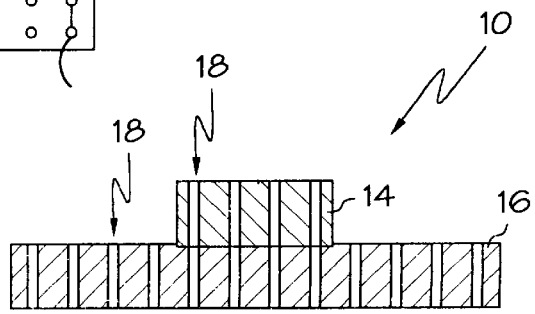
FIG. 2 is a cross sectional view of the perforated reflective trim of FIG. 1.

FIG. 1 shows a perforated reflective trim in accordance with the present invention, generally designated 10. The perforated reflective trim 10 comprises a strip of reflective trim 12, which can be any suitable reflective trim material for the garment to which is to applied. As shown in FIG. 2, the reflective trim 12 comprises a reflective portion 14 and a substrate portion 16 of conventional construction. The reflective portion 14 is adhesively bonded to a plastic composite substrate portion 16. The substrate portion 16 is made of a nonporous material, preferably a plastic composite. Nonporous, as used herein, describes the substrate material itself as being substantially impermeable to the passage of air or moisture in those areas between the perforations. For use with firefighter garments, the reflective trim 12 is preferably selected from the group consisting of SCOTCHLITE™ and SCOTCHLITE™II TRIPLE TRIM, both commercially available from Minnesota Mining and Manufacturing Co. The perforated reflective trim 10 also includes a multiplicity of open (that is, unobstructed) perforations 18. The perforations 18 are sized and distributed so as to permit water or moisture vapor transport through the perforations 18.

The reflective trim 12 has a longitudinal axis 20 and a lateral axis 22. In one embodiment, for a piece of trim material three inches wide, the perforations 18 preferably are arranged in 12 lines of perforations parallel to the longitudinal axis 20. The lines of perforations 18 preferably have about ¼" interval between adjacent lines of perforations 18 and the distance between adjacent perforations in the longitudinal direction is about 3/16". The perforations preferably are arranged in a pattern of about 24 perforations per square inch. It is within the scope of the invention to have the perforations arranged in any configuration which provides for adequate water or vapor transport, provided that minimum visibility levels are maintained. For example, it is within the scope of the invention to have intervals between adjacent perforations ranging from ⅛" to ½" and densities of the perforations ranging from 8 to 36 per square inch.

The perforated reflective trim 10 preferably is attached to garments using any suitable means known in the art. Means for attaching the perforated reflective trim to garments include, but are not limited to, adhesives, stitches, snaps, or strips of hook and loop material. Preferably the perforated reflective trim is stitched to the outermost layer of the garment. As shown in FIG. 1, it is desirable that the thread 24 used to stitch the perforated reflective trim to the garment is passed through the perforations 18 already formed in the reflective trim along the opposing edges of the trim running parallel to the longitudinal axis 20. By doing so, the thread avoids excessive contact with and pressure created by non-perforated portions of the reflective trim 12.

The perforated reflective trim of the present invention is made by creating perforations within a sheet of non-perforated reflective trim material 12. The non-perforated reflective trim material 12 typically is formed in continuous strips. Perforations 18 are made in the non-perforated reflective trim material 12 by passing the non-perforated reflective trim material 12 through a multi-needle sewing machine, preferably a chain stitch machine. The needles used within the sewing machine preferably have a needle size of 22. The resulting perforations are about 1/16" to ⅛" in diameter. However, those skilled in the art will appreciate that needles having different sizes can be used with the invention so long as the perforations created within the reflective trim material permit water vapor transport through the perforations. For example, perforation diameters of 1/32" to ¼" are within the scope of the invention.

Figure 3:
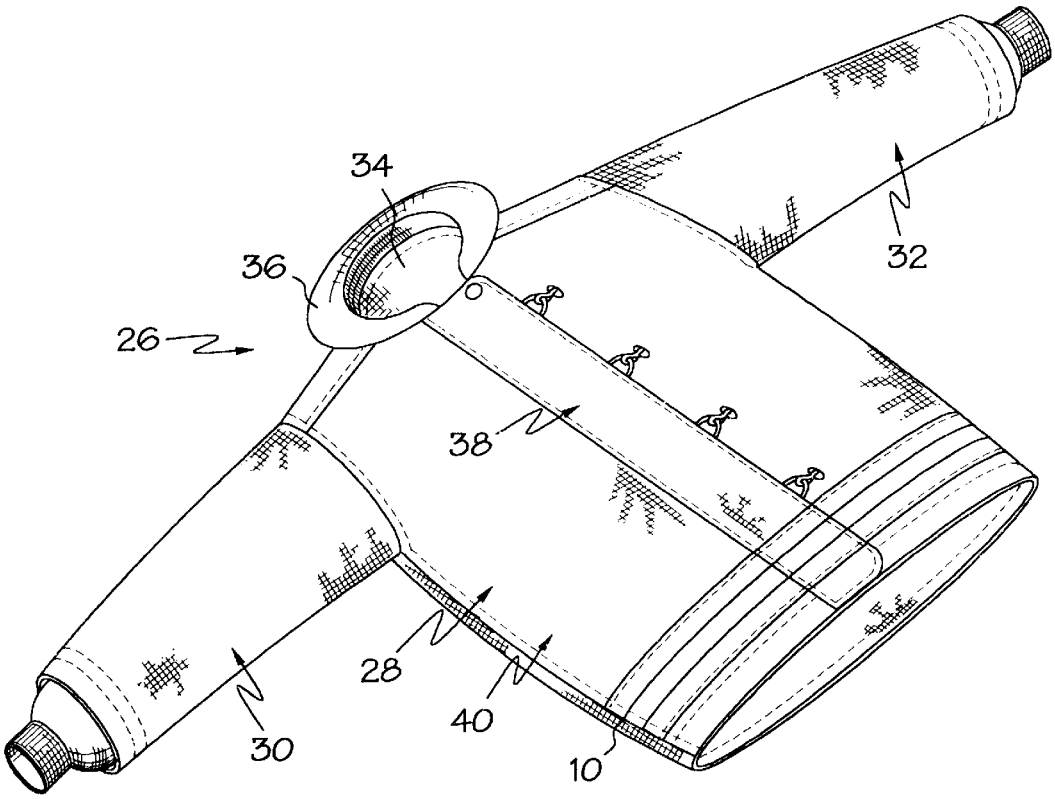
FIG. 3 is a somewhat schematic, perspective view of a firefighter garment incorporating trim of FIG. 1.

As shown in FIG. 3, the perforated reflective trim of the invention is preferably attached to a garment, preferably a protective garment in the form of a firefighter garment, generally designated 26. The garment 26 is a firefighter turnout coat having a body portion 28, sleeves 30, 32, a neck opening 34, a collar 36 surrounding the neck opening, and a front closure, generally designated 38. Such a garment is disclosed in Aldridge U.S. Pat. No. 5,539,928, the disclosure of which is incorporated herein by reference.

Figure 4:
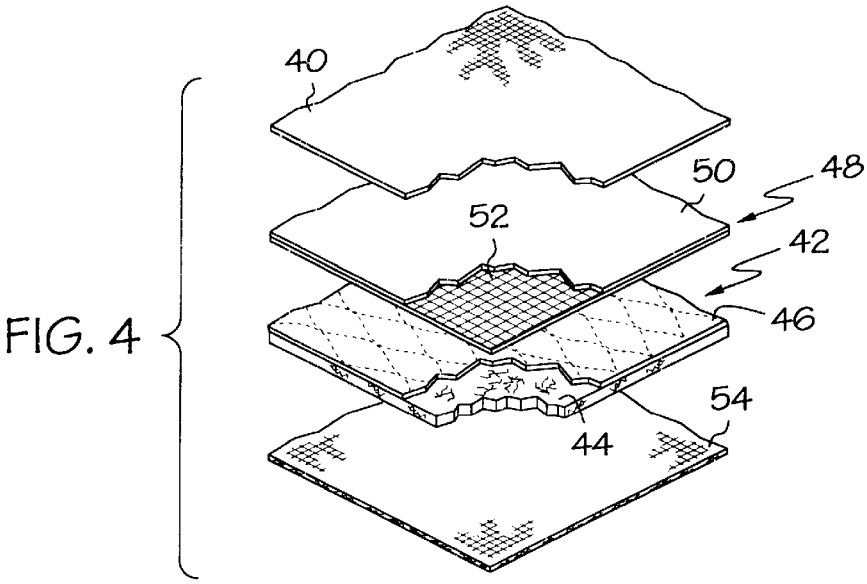
FIG. 4 is an exploded, perspective view of a detail of the garment of FIG. 3.

As shown in FIGS. 3 and 4, the garment 26 includes an abrasion, heat and flame resistant outer shell, generally designated 40, which covers substantially the entire outer surface of the garment. The outer shell is a compact weave of an aramid material such as NOMEX or KEVLAR (both are trademarks of E.I. DuPont de Nemours & Co., Inc.), a blend of such aramid materials, a polybenzamidazole such as PBI (a trademark of Celanese Corp.), or a blend of aramid and PBI materials. A thermal liner, generally designated 42, extends substantially throughout the garment 26 and includes layer 44 of insulative material quilted to a layer 46 of aramid face cloth material. A discrete moisture barrier layer 48 is positioned between the thermal liner 42 and the outer shell 40. The moisture barrier includes a semipermeable membrane layer 50, which is moisture vapor permeable but impermeable to liquid moisture bonded to a substrate 52 of flame and heat resistant material, such as an aramid or PBI material. A second layer 54 of aramid face cloth material is positioned adjacent to the thermal liner 42 and protects the thermal liner from the clothing of the wearer.

Reflective trim of the invention 10 preferably is attached to the outer shell 40 of the garment 26 and positioned in accordance with the N.F.P.A. 1971 standard. However, it is within the scope of the invention to place the perforated reflective trim at any location on the garment.

Preferably, the reflective trim material meets visibility requirements of N.F.P.A. 1971, 1997 edition, which is incorporated by reference herein.

EXAMPLE 1

Table 1 illustrates the improved water and moisture vapor permeability of the perforated trim compared to the trim without perforations. The samples tested included the PBI outer shell alone, the PBI shell with a piece of reflective trim sewn to it and the PBI shell with a piece of perforated reflective trim sewn to it. Each sample was placed over a pan of heated water for a period of four hours. Permeability of the sample was determined by measuring the water loss from the pan. Increased water loss corresponds to an increase in permeability of the sample. The efficiency corresponds to the water loss divided by the initial weight of water in the pan expressed as a percentage. The amount of water gained by the sample was also measured and the percent water gain was calculated. Calculations for percent water gain were based on the weight of the PBI outer shell alone and the total weight when combined with the reflective trim. Reflective trim without perforations caused a significant increase in the amount of water that was retained in the PBI outer shell.

TABLE 1

| Product Tested | PBI Outer Shell | PBI Outer Shell with Perforated Trim | PBI Outer Shell with Trim (No Perforations) |
|---|---|---|---|
| Total Water Loss (g) | 57 | 38.3 | 9 |
| Efficiency | 100% | 66.6% | 15.5% |
| Water in Sample (g) | 0 | 13 | 30 |
| % Gain (Based on total sample wt) | 0 | 24% | 54.5% |

TABLE 1-continued

| Product Tested | PBI Outer Shell | PBI Outer Shell with Perforated Trim | PBI Outer Shell with Trim (No Perforations) |
|---|---|---|---|
| % Gain (Based on wt of PBI outer Shell) | 0 | 54% | 120% |

The test results as shown in Example 1 are very repeatable, and they show that using the perforated reflective trim of the present invention provides an improvement over using the conventional reflective trim (non-perforated reflective trim).

Having described the invention in detail and by reference to the drawings, it will be apparent that modifications and variations are possible without departing from the scope of the invention as defined by the following claims.

What is claimed is:

1. A firefighting garment comprising:

an outer shell of abrasion, flame and heat resistant material selected from a group consisting of an aramid material, a blend of aramid materials, a polybenzarnidazole material, and a blend of aramid and polybenzamidazole materials;

a reflective trim attached to said outer shell;

wherein the reflective trim includes a multiplicity of open, unobstructed perforations spaced over an outer surface thereof, such that water and water vapor transport through said trim is enhanced.

2. The firefighting garment of claim 1 wherein said perforations have a density of from about 8 to 36 perforations per square inch.

3. The firefighting garment of claim 2 wherein said perforations have a density of about 24 perforations per square inch.

4. The firefighting garment of claim 1 wherein said perforations are of substantially uniform size.

5. The firefighting garment of claim 1 wherein said perforations are between about 1/32" to 1/25" in diameter.

6. The firefighting garment of claim 5 wherein said perforations are between about 1/16" to 1/8" in diameter.

* * * * *